US005486026A

United States Patent [19]

Borgardt

[11] Patent Number: 5,486,026

[45] Date of Patent: Jan. 23, 1996

[54] DOUBLE-ACTING POSITIVE LATCH SYSTEM FOR SLIDING DOORS

[76] Inventor: Ronald Borgardt, 2316 Tifton St., Kenner, La. 70062

[21] Appl. No.: 193,953

[22] Filed: Feb. 9, 1994

[51] Int. Cl.[6] ..... E05C 19/06

[52] U.S. Cl. ..... 292/71; 292/92; 292/DIG. 46; 49/141; 49/180

[58] Field of Search ..... 292/167, 171, 292/D21, D46, 5, 6, 92, 93, DIG. 65, 71, 74; 49/141, 176–178, 180, 163; 70/92

[56] References Cited

U.S. PATENT DOCUMENTS

| | | | |
|---|---|---|---|
| 390,409 | 10/1888 | Spengler | 292/137 |
| 776,177 | 11/1904 | George | 292/74 |
| 958,353 | 5/1910 | Teich | 49/141 |
| 969,624 | 9/1910 | Hoes | 292/DIG. 21 |
| 1,085,065 | 1/1914 | Speicher | 49/177 |
| 1,896,745 | 1/1931 | Hein | 292/DIG. 21 |
| 2,165,943 | 3/1938 | Schuler | 49/177 |
| 3,136,538 | 6/1964 | Dimmitt | 49/177 |
| 3,354,581 | 10/1965 | Dimmitt | 49/177 |
| 3,466,805 | 8/1967 | Muessel | 49/177 |
| 4,461,160 | 7/1984 | Van Gompel | 292/171 |
| 4,475,311 | 10/1984 | Gibson | 49/176 |
| 5,165,737 | 11/1992 | Reigelman | 49/176 |

*Primary Examiner*—Peter M. Cuomo
*Assistant Examiner*—Gary Estremsky
*Attorney, Agent, or Firm*—Pravel, Hewitt, Kimball & Krieger

[57] ABSTRACT

A positive latch system for sliding doors having a break away feature, which includes a door which is capable of sliding along a track between open and closed positions; means for allowing the sliding door to breakaway from its linear track, and swing fully open for greater access to the opening; latching mechanism positioned on the door, for allowing the door to positively latch closed either from the sliding configuration are the breakaway configuration, the mechanism including a latch bolt depressible upon engaging the latch plate, from at least two directions, each direction the latch bolt depressing for engaging into the latch plate port, and means on the latch plate for allowing the latch bolt to depress when engaging from either of the two directions.

9 Claims, 3 Drawing Sheets

DOUBLE-ACTING POSITIVE LATCH SYSTEM FOR SLIDING DOORS

BACKGROUND OF THE INVENTION

1. Field of the Invention

The present invention relates to an improved latching system for sliding doors. More particularly, the present invention relates to a latching system for a sliding door which has the capability of effecting a positive latching both when the door is slid closed or hinged closed in its use.

2. General Background

Entry doors for hospital ICU/CCU rooms have always been equipped with doors which have the ability to both slide closed, and under emergency circumstances, swing open to provide greater access to the ICU room. Recent changes in the hospital Life Safety Code regulations now require that for any ICU/CCU area 5000 square feet or larger, each patient sleeping room door must be positively latched when it is in the closed position. Previously, the ICU/CCU rooms were equipped with manual sliding doors that provided for full access into or out of the room through the breakaway provision of the sliding door. However, because of the requirement for positive latching when closed, there is now a need to effect a positive latching mechanism which enables the door to positively latch both when slid closed and when it returns shut from the breakaway configuration.

SUMMARY OF THE PRESENT INVENTION

The apparatus of the present invention solves the problems in the art in a simple and straightforward manner. What is provided is a positive latching system for sliding doors having a break away feature, which includes a door which is capable of sliding along a track between open and closed positions; means for allowing the sliding door to breakaway from its linear track, and swing fully open for greater access to the opening; a latching mechanism positioned on the door, for allowing the door to positively latch closed either from the sliding configuration or the breakaway configuration, the mechanism including a latch bolt depressible upon engaging the latch plate, from at least two directions, in each direction the latch bolt slidingly engaging into the latch plate port, and means on the latch plate for allowing the latch bolt to depress when engaging from either of the two directions, Therefore, it is a principal object of the present invention to provide a positive latch apparatus for sliding doors which allows positive latching from at least two directions;

It is a further object of the present invention to provide a modified latch bolt/latch plate configuration which allows the latch bolt to depress and engage the latch plate when the latch plate is struck by the latch bolt from at least two directions;

It is a further object of the present invention to provide a positive latching mechanism for sliding doors having a breakaway feature so that the door may be positively latched closed when the door is slid closed or swung closed, with the latch bolt engaging the latch plate from either direction and effecting positive latching.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 1:
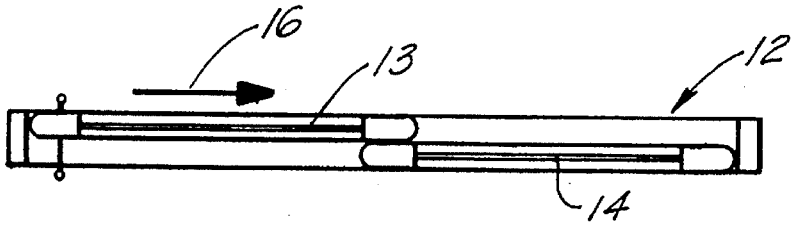
FIGS. 1 through 3 illustrate top sequential views of a sliding door assembly sliding between open and closed positions and in the breakaway position.
Figure 2:
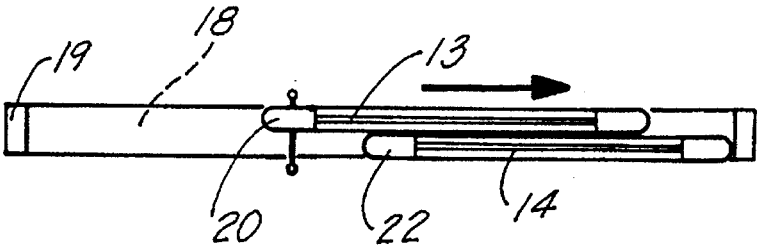
Figure 3:
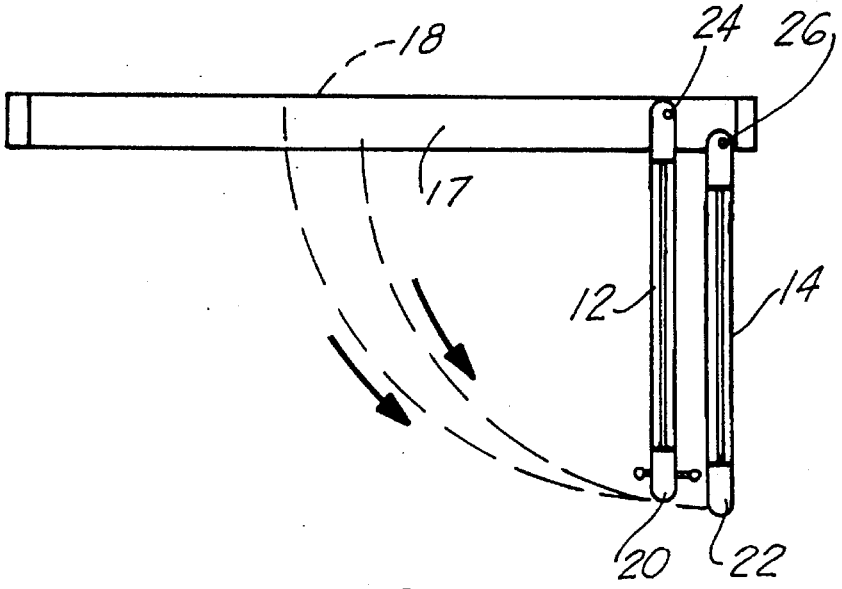

FIGS. 1 through 6 illustrate the preferred embodiment of the present invention by the numeral 10. As illustrated, the positive latching system 10, which incorporates the unique latching mechanism 11, is illustrated as appearing on a pair of sliding doors, having a break away feature, as will be discussed in general in relation to FIGS. 1 through 3. As illustrated in FIG. 1, sliding door assembly 12 is seen in top view, including a first door 13 and a second door 14. The first door 13 would be slidable in relation to the stationary door 14, as seen by the arrow 16. FIG. 2 illustrates the doors 13, 14 having completed the sliding feature, and leaving a passageway 18, through which a person may move either entering or exiting the space. As seen further in FIG. 3, the sliding door assembly 12 has the additional feature, that when the doors 12, 14, are in the open configuration, as seen in FIG. 2, that their trailing ends 20, 22, may be broken away from the upper track 17, mounted on the upper door frame 19, upon which the doors are travelling in their sliding path, in order to allow greater access opening 18 during emergency situations. This feature is achievable by the doors 12, 14 having a hinge members 24, 26 on their leading edge, which allow the doors to swing open in the direction of arrow 30, as seen in FIG. 3. It should be made clear that the sliding/breakaway features of doors, such as emergency doors in hospitals, are quite common, and are required by the hospital safety codes.

What is critical to the present invention is the means by which the sliding doors, as illustrated effect a positive locking against the door frame 19, either when the doors are slid shut, or when the doors are swung closed from the breakaway position, utilizing the same latching system. The positive latching system 10 which achieves this is illustrated generally in FIG. 4. As seen in the figure, latching system 10 would comprise generally a pair of door handles 30, 32, with the handles allowing access to the door from either side of the sliding door 12. The handles 30, 32 would include a flexible cord 34, attached at its first end 36, to the door handle shaft 33, and would extend upward through the door body, to attach at its second end 37 to the lower end 39 of a spring-loaded latch bolt 38. The spring would be housed within a housing 41, as illustrated, so that upon rotation of either handle 30, 32, the cord 34 would pull downward on the bolt 38, which would disengage from an opening within a bolt plate 40, mounted in the frame 19 of the door, and would allow door 12 to either slide along the track 17 in frame 19, as seen in FIGS. 1 and 2, or would allow the door 12 to breakaway from track 17, as seen in FIG. 3.

Figure 5:
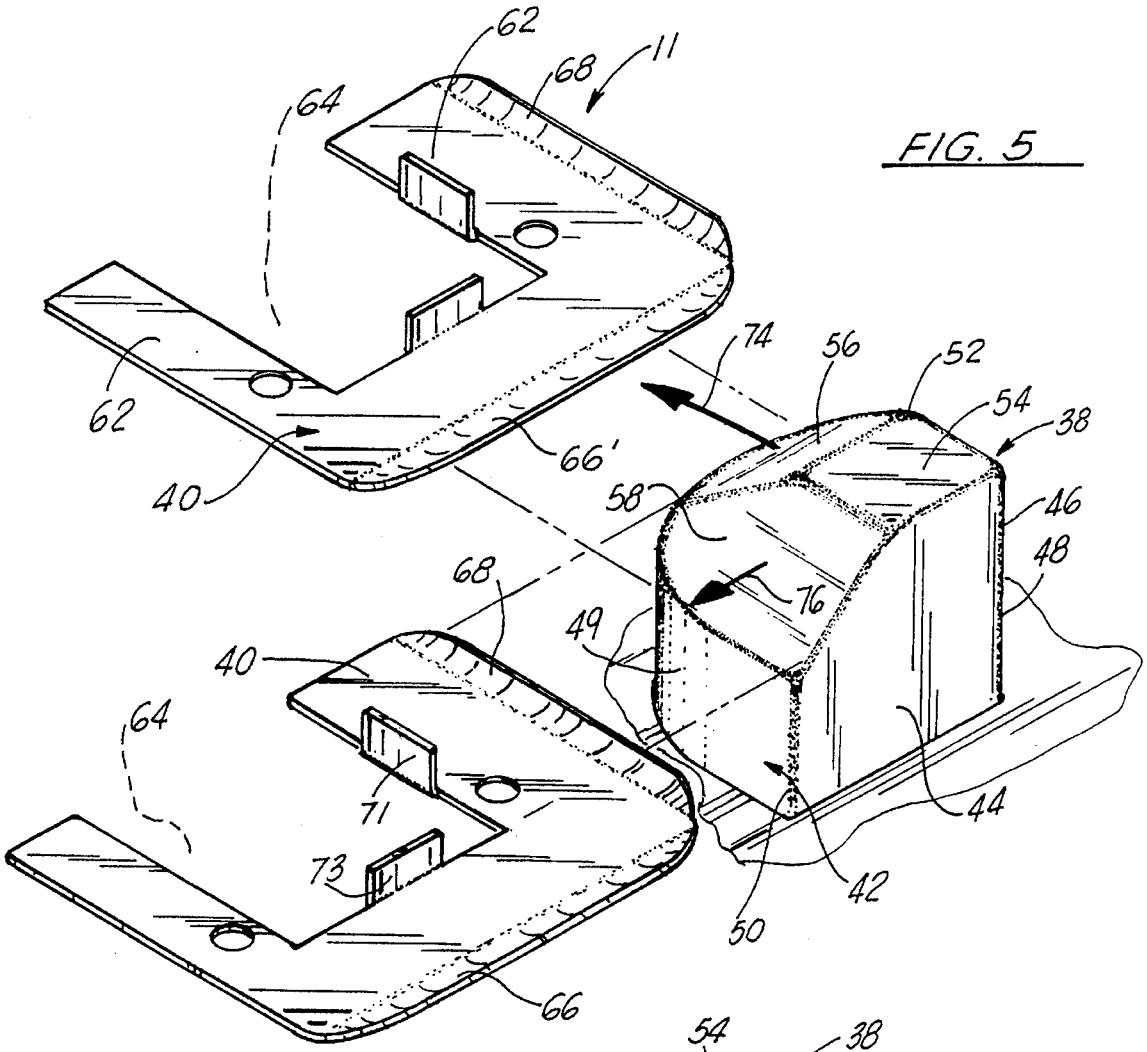
FIG. 5 illustrates an isolated view of the latch bolt/latch plate assembly utilized in the preferred embodiment of the present invention, prior to effecting positive latching.
Figure 6:
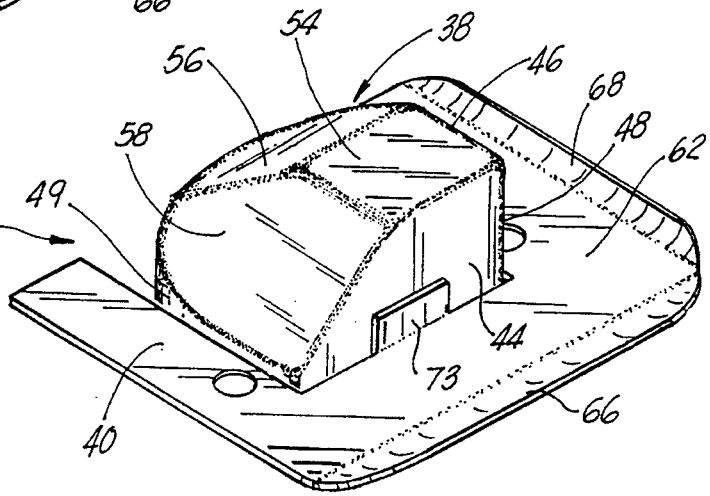
FIG. 6 illustrates an isolated view of the latch bolt/latch plate assembly utilized in the preferred embodiment of the present invention, after positive latching has occurred either from sliding or swinging the door closed.

Turning now to the new and improved features of the present invention, reference is made to FIGS. 5 and 6 which illustrate isolated views of the improved latching mechanism 11 of latching system 10 of the present invention. As was stated earlier, because of hospital code requirements, when the door 12 is either slid shut, as seen in FIG. 1, or when the doors 10, 12 are returned to the track 17 after being broken away, as seen in FIG. 3, upon their return to the closed position in track 17, the doors must automatically positively latch shut. That is, the doors must not require manual manipulation of the latches in order to assure positive latching between the doors 12, 14 and the door frame 19. This is achieved by the modified latch bolt/latch plate mechanism 11 as seen in FIGS. 5 and 6. Mechanism 11, which includes the modified latch bolt 38 and the modified latch plate 40, provides a novel means for allowing the door to achieve a positive latch either when slid closed or when swung closed from the breakaway position.

Figure 4:
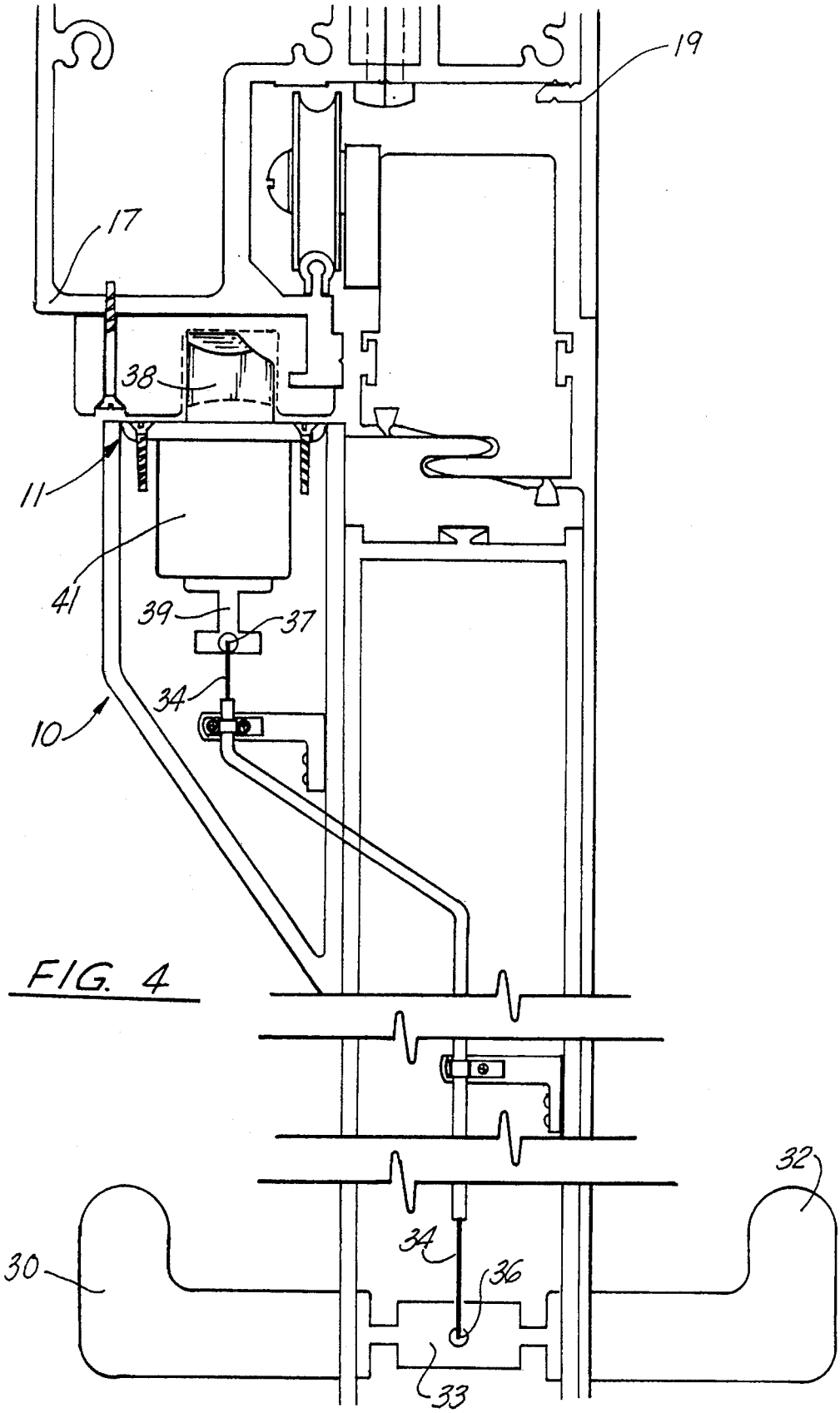
FIG. 4 illustrates an cross-sectional view of the preferred embodiment of the positive latching system utilized in the present invention.

As seen in FIG. 5, and as is illustrated in overall side view in FIG. 4, latch bolt 38 includes a bolt body 42, extending out from the top of door 12, the lower end of which is attached to cord 34, as was discussed earlier, in order to move from the extended position as seen in FIG. 5, to the retracted position, as will be discussed further. Latch bolt 38 includes a first flat side 44, and a second flat side 46, each terminating at a common edge 48. A curved wall portion 49 of latch bolt 38 extends from a second edge 50 of wall 44, to a second edge 52 of wall 46, to complete the outer wall configuration of bolt 38. Bolt 38 further includes a flat truncated top portion 54 as illustrated. Top portion 54 is interconnected with walls 44, 46 and 49 with first and second arcuate upper latch plate engaging surfaces 56, 58, which serve to retract bolt latch 38 as the bolt makes contact with the bolt plate 40, as will be described further.

As seen in the FIG. 5, latch plate 40 resembles a typical latch plate which would be commonly utilized in conjunction with latch bolts. That is, it includes a flat metal plate body 62, having an opening 64, which would be attached via screws or the like to the door frame 19. Opening 64 would serve as an entry port for the latch bolt to enter an opening in the door frame when it is fully retracted. When locking occurs, latch bolt body 38 enters opening 64, to effect the positive latch, as seen in FIG. 6. However, in this invention, latch plate 40 is likewise ingeniously modified to serve as a means to allow the latching of the door from two different directions. In order to achieve this, the plate body 62 has a first and second upturned lip portions 66, 68 which would slidingly engage the leading surfaces 56, 58 of bolt 38, so as to allow the bolt 38 to retract against the bias of the spring within housing 41, and after entering opening 64, returning to the extended position, and latched in position. However, as seen, latch plate 40, has the first arcuate lip portion 66 for engaging the first leading beveled surface 56 of latch bolt 38, when the door is slid closed, as seen by arrow 74. The plate 40 also includes a second arcuate lip portion 68, which would engage the second beveled surface 68 of latch bolt 38, when the door is being returned from the breakaway position, as illustrated by the arrow 76. Therefore, unlike the current state of the art, this latch bolt/latch plate arrangement allows a positive latching either when door 12 is slid closed or hinged closed. When slid, beveled surface 56 of latch bolt 38 engages lip 66 of plate 40, and retracts, to return to the extended position. Likewise, should door 12 have to be moved to the breakaway position, as seen in FIG. 3, when the doors are returned, the beveled surface 58 of latch bolt 38 engages lip 68 of plate 40, and likewise retracts and returns to extend into opening 64 of plate 40, again effecting a positive latching.

As seen in FIG. 6, when the latch bolt 38 is returned to the retracted position within opening 64 of plate 40, each flat wall 44, 46 of the bolt is engaged against the upright stops 71, 73 of plate 40, thus disallowing any return of the door 12 to the open position, without manual retraction of bolt latch 38 by either of handles 30, 32. It should be made perfectly clear that although FIG. 5 illustrates more than one bolt plate 40, these multiple views are being used to illustrate the fact that the bolt can be retracted into the plate opening by engaging the plate either from the direction as illustrated by arrow 74, or in the direction as illustrated by arrow 76. However, in reality, there would be only one bolt plate 40 for receiving bolt latch 38 thereunto, as illustrated in FIG. 6, depending on the direction from which bolt latch approaches and engages bolt plate 40.

The following table lists the part numbers and part descriptions as used herein and in the drawings attached hereto.

PARTS LIST

| Part Number | Description |
|---|---|
| 10 | positive latching system |
| 11 | latching mechanism |
| 12 | sliding door |
| 14 | stationary door |
| 16 | arrow |
| 17 | upper track |
| 18 | passageway |
| 19 | door frame |
| 20, 22 | trailing ends |
| 24, 26 | hinge members |
| 30 | arrow |
| 30, 32 | door handles |
| 33 | door handle shaft |
| 34 | flexible cord |
| 36 | first end |
| 37 | second end |
| 39 | lower end |
| 38 | latch bolt |
| 40 | latch plate |
| 41 | housing |
| 42 | bolt body |
| 44 | first flat side |
| 46 | second flat side |
| 48 | common edge |
| 49 | curved wall |
| 50 | second edge |
| 52 | second edge |
| 54 | truncated top |
| 56 | first latch plate engaging surface |
| 58 | second latch plate engaging surface |
| 62 | metal plate body |
| 64 | opening |
| 66 | first arcuate lip portion |
| 68 | second arcuate lip portion |
| 70 | first vertical stop |
| 71, 73 | upright stops |
| 72 | second vertical stop |
| 74 | arrow |
| 75 | stops |
| 76 | arrow |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A positive bolt latching system for sliding doors having a breakaway feature, the system comprising:

a) a first door slidable upon a track between open and closed positions;

b) means for allowing the sliding door to breakaway from the track, and to swing away from the track to effect a greater opening in the passageway;

c) a latching bolt engageable in an opening in a latch plate, the latching bolt having at least two surfaces, a first beveled surface for engaging the latch plate when the door is slid closed from a first direction and a second beveled surface for engaging the latch plate when the door is swung closed from a second direction, in either direction, the latching bolt retracting to latching engage into the latch plate and effect an automatic positive latch.

2. The system in claim 1, wherein each beveled surface would engage a portion of the latch plate when the latching bolt makes contact with the latch plate either when the door is being slid closed, or when the door is being returned to the track following breakaway of the door from the frame.

3. The system in claim 1, wherein the door latching means is opened via a handle on the door, which disengages the latch bolt from the latch plate and allows the door to be slid open or to be broken away from the door frame.

4. A positive bolt latching system for sliding doors having a breakaway feature, the system comprising:

a) a first door slidable upon a track between open and closed positions;

b) means for allowing the sliding door to breakaway from the track, and to swing away from the track to effect a greater opening in the passageway;

c) latching means positioned between the door and the door frame, for allowing the door to positively latch closed when the door is slid to the closed position, and to positively latch closed when the door is returned to the track after being broken away from the track, without manual latching in either position, the latching means further comprising a latch bolt engageable in an opening in a latch plate, the latch bolt having at least two beveled surfaces which, when either surface engages the latch plate, allows the bolt to retract so that it can engage into an opening in the latch plate, and effect the automatic positive latch.

5. The system in claim 4, wherein the latch bolt further includes at least two beveled surfaces, each surface which would engage a portion of the latch plate when the latch bolt makes contact with the latch plate either when the door is being slid closed, or when the door is being returned to the track following breakaway of the door from the frame.

6. The system in claim 4, wherein the door latching means is opened via a handle on the door, which disengages the latch bolt from the latch plate and allows the door to be slid open or to be broken away from the door frame.

7. A positive bolt latching system for sliding doors having a breakaway feature, the system comprising:

a) a first door slidable upon a track between open and closed positions;

b) means for allowing the sliding door to breakaway from the track, and to swing away from the track to effect a greater opening in the passageway;

c) latching means positioned between the door and the door frame, for allowing the door to positively latch closed when the door is slid to the closed position, and to positively latch closed when the door is returned to the track after being broken away from the track, without manual latching in either position, the latching means further comprising a latch bolt engageable in an opening in a latch plate, the latch bolt having at least two beveled surfaces which, when either surface engages the latch plate, allows the bolt to retract so that it can engage into an opening in the latch plate, and effect the automatic positive latch.

8. The system in claim 7, wherein the latch bolt includes at least two surfaces which, when either surface engages the latch plate, allows the bolt to retract to that it can engage into an opening in the latch plate, and effect the automatic positive latch.

9. In a positive bolt latching system for sliding doors of the type having a breakaway feature, and a first door slidable upon a track between open and closed positions, hinge means for allowing the sliding door to breakaway from the track, and to swing away from the track to effect a greater opening in a passageway; the improvement comprising:

latching means positioned between the door and the door frame, for allowing the door to positively latch closed when the door is slid to the closed position, and to positively latch closed when the door is returned to the track after being broken away from the track, without manual latching in either position, the latching means further comprising a latch bolt engageable in an opening in a latch plate, the latch bolt having at least two beveled surfaces which, when either surface engages the latch plate, allows the bolt to retract so that it can engage into an opening in the latch plate, and effect the automatic positive latch.

* * * * *